US005355773A

United States Patent [19]

Winkels

[11] Patent Number: 5,355,773

[45] Date of Patent: Oct. 18, 1994

[54] HYDRAULIC SYSTEM FOR CONTROLLING CONTACT PRESSURE

[75] Inventor: Günter Winkels, Zweibrücken, Fed. Rep. of Germany

[73] Assignee: Deere & Company, Moline, Ill.

[21] Appl. No.: 843,500

[22] Filed: Feb. 28, 1992

[30] Foreign Application Priority Data

Mar. 4, 1991 [DE] Fed. Rep. of Germany ..... 4106845

[51] Int. Cl.[5] ..... F15B 13/043

[52] U.S. Cl. ..... 91/452; 91/454; 91/468; 60/460

[58] Field of Search ..... 91/443, 446, 448, 452, 91/454, 468; 60/460, 466

[56] References Cited

U.S. PATENT DOCUMENTS 3,597,907 8/1971 Neal .
4,276,810 7/1981 Zeuner et al. .
4,276,811 7/1981 Zeuner et al. .
4,401,009 8/1983 Zeuner et al. .
4,622,803 11/1986 Lech .
4,873,817 10/1989 Harms .

FOREIGN PATENT DOCUMENTS 2024328 12/1970 Fed. Rep. of Germany .
1937346 2/1971 Fed. Rep. of Germany .

OTHER PUBLICATIONS

Bosch–Hydraulik, Systeminformation, dated May 1984.
Bosch, Fur Hydraulik, Prodkinformation dated Mar. 1990.
Deere technical manual, "Hydraulic Diagrams", pp. 270–20–4 to 270–15–9 Mar. 1986.
Patents abstract of Japan, application No. 62–47214, M–780 Dec. 23, 1988, vol. 12/No. 495.

*Primary Examiner*—Edward K. Look
*Assistant Examiner*—F. Daniel Lopez

[57] ABSTRACT

A hydraulic system for controlling the contract force of a hydraulic device. A proportional pressure relief valve acts as pilot valve for a main valve that controls the lowering process. The proportional pressure relief valve is provided with a solenoid whose voltage can be varied. A pressure sensing line is also applied to the same side of the valve as the solenoid for biassing the valve against a spring.

4 Claims, 2 Drawing Sheets

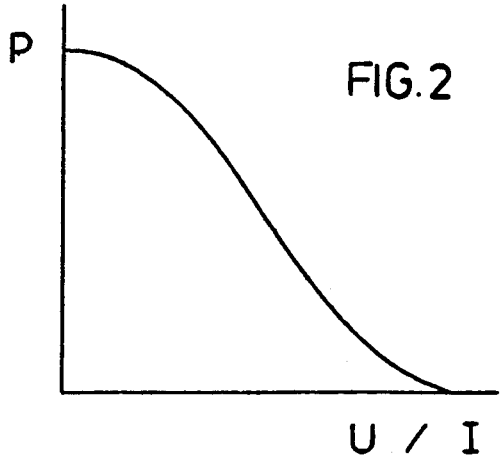
FIG. 2
FIG. 3
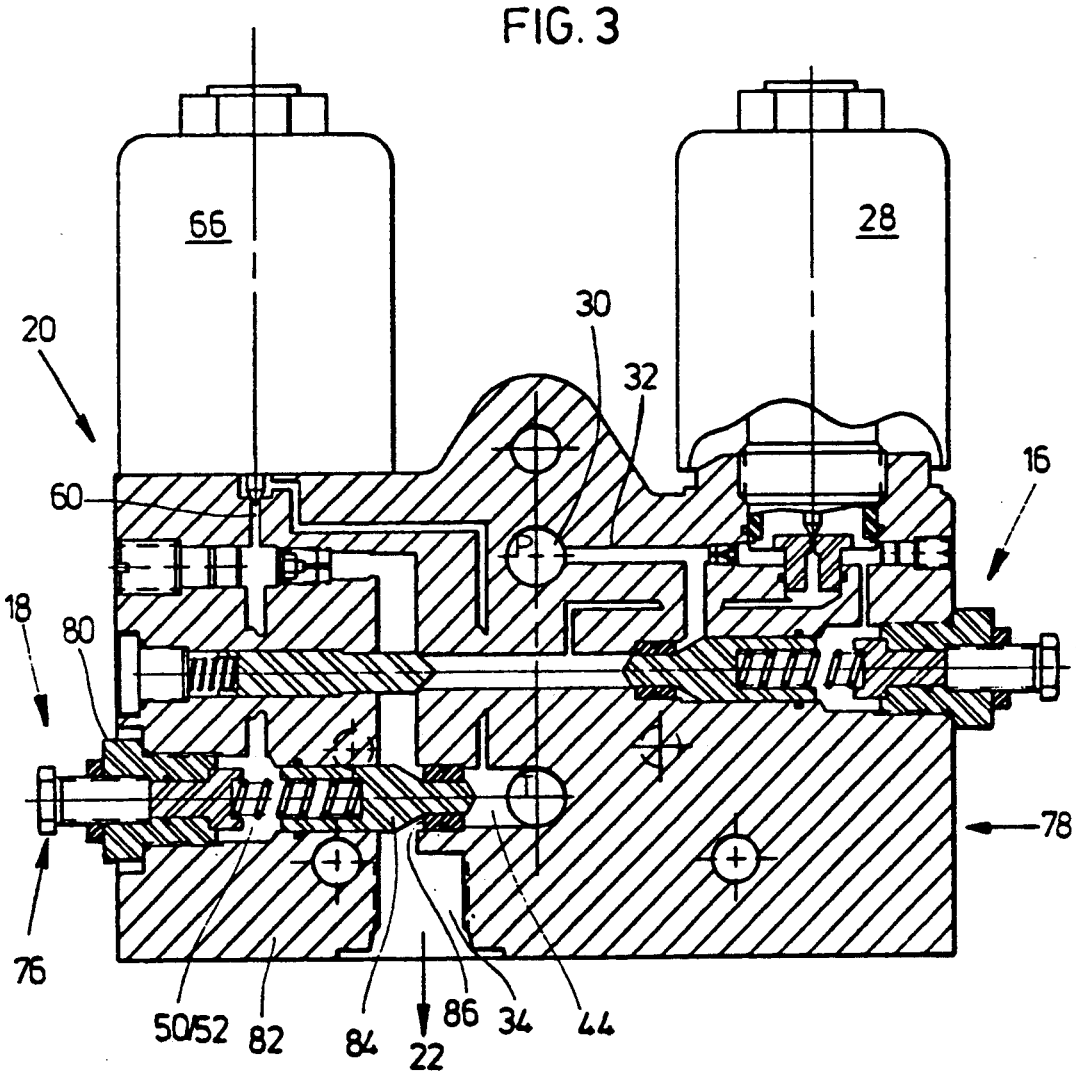

HYDRAULIC SYSTEM FOR CONTROLLING CONTACT PRESSURE

BACKGROUND OF THE INVENTION

1. Field of the Invention

The invention is directed to a hydraulic system for controlling the contact force applied by a hydraulic device. The system is provided with a pilot-controlled main valve and a solenoid-controlled pilot valve. The main valve can be moved by means of the pilot valve from a position that supplies pressurized fluid to a hydraulic device to a position that drains pressurized fluid from the hydraulic device.

2. Description of the Prior Art

Hydraulic systems to control the position or the contact pressure of a hydraulic device are widely known. Some of these systems are used to control the distance of an agricultural implement, such as a harvesting platform, from the ground.

Pressurized fluid can be supplied to lifting cylinders through a main valve (TM-1352, page 270-20-5 and 270-20-7 through 270-20-9, Mar-86, by John Deere), when this is switched from a blocking position to a through position. The switching is accomplished with a pilot valve, that is remotely controlled and, depending on the control operation, reduces the pilot pressure behind the main valve, so that it is moved to the through position by means of a pressure applied to the other side of the main valve. This hydraulic system provides only a controlled lifting or lowering of an implement without any automatic position control of the implement.

According to another control scheme (Bosch—Hydraulics, System Information, Circuitry and Components for Combines, K6/VKD 2-BEy 017/5 De (5.04), pages 4 and 5) a manually-operated three-way valve is followed by two two-way valves and one adjustable pressure relief valve, where the pressure relief valve and a two way valve are required to move the other two-way valve from a blocking position to a through position upon reaching a pre-set pressure. The cost of this system in terms of valves and control connections is relatively expensive.

SUMMARY

It is the main object of the present invention to provide a hydraulic system for the controlling the contact force applied by a hydraulic device.

It is a feature of the present invention that the system is provided with a pilot-controlled main valve and a solenoid-controlled pilot valve, that are arranged in such a way that with a predetermined pressure is automatically applied by the hydraulic device during a work operation.

The pilot valve is used to bleed off pressure behind the main valve, as soon as the pressure applied to the pilot valve exceeds the force opposing it on the other side of the pilot valve. This other force could be applied by a spring, a solenoid or another pressure. Such a pressure increase could occur when, for example, the hydraulic device moves away from the ground with an implement, due to the contour of the ground, and no longer is in contact with it. Then the opening of the main valve permits the pressurized fluid to bleed off from the hydraulic device, so that the implement can be lowered until the predetermined contact pressure is again reached at the hydraulic device.

If the voltage or the current flow applied to the solenoid can be varied, the pressure at which the pilot valve responds and the main valve is actuated can be varied. Such variability is valuable if the operating conditions of the implement carried by the hydraulic device change, and an adjustment is required or desired.

The pressure at which the pilot valve responds can be set by a spring, since the spring force is constant and can be precalculated.

A pressure relief valve with pilot control and a solenoid with variable applied voltage and an inverted characteristic has become known [Bosch - Hydraulics - Production information -HP/vEK 2-BEY 013/5 De, En, Fr (3.90)]; however, it is not known practice to use such a valve for the control of contact pressure or the position of a hydraulic device.

If the main valve is so designed that the flow of pressurized fluid through it is adjustable, the speed at which the hydraulic device is lowered can be varied, so that upon actuation of the pilot valve the hydraulic device can be lowered at a variable speed until a certain contact pressure is reached. It is generally known that the flow of pressurized fluid through the main valve can be varied.

The present invention is particularly well suited for controlling the position of an implement on an agricultural machine, for example, a header on a harvesting machine. As such implements are subject to constantly changing operating conditions and varying contact pressures and lowering speeds are desirable features.

BRIEF DESCRIPTION OF THE DRAWINGS

FIG. 2 illustrates the characteristic of the solenoid.

FIG. 3 is a cross sectional view of a valve block of the hydraulic system.

DETAILED DESCRIPTION

Figure 1:
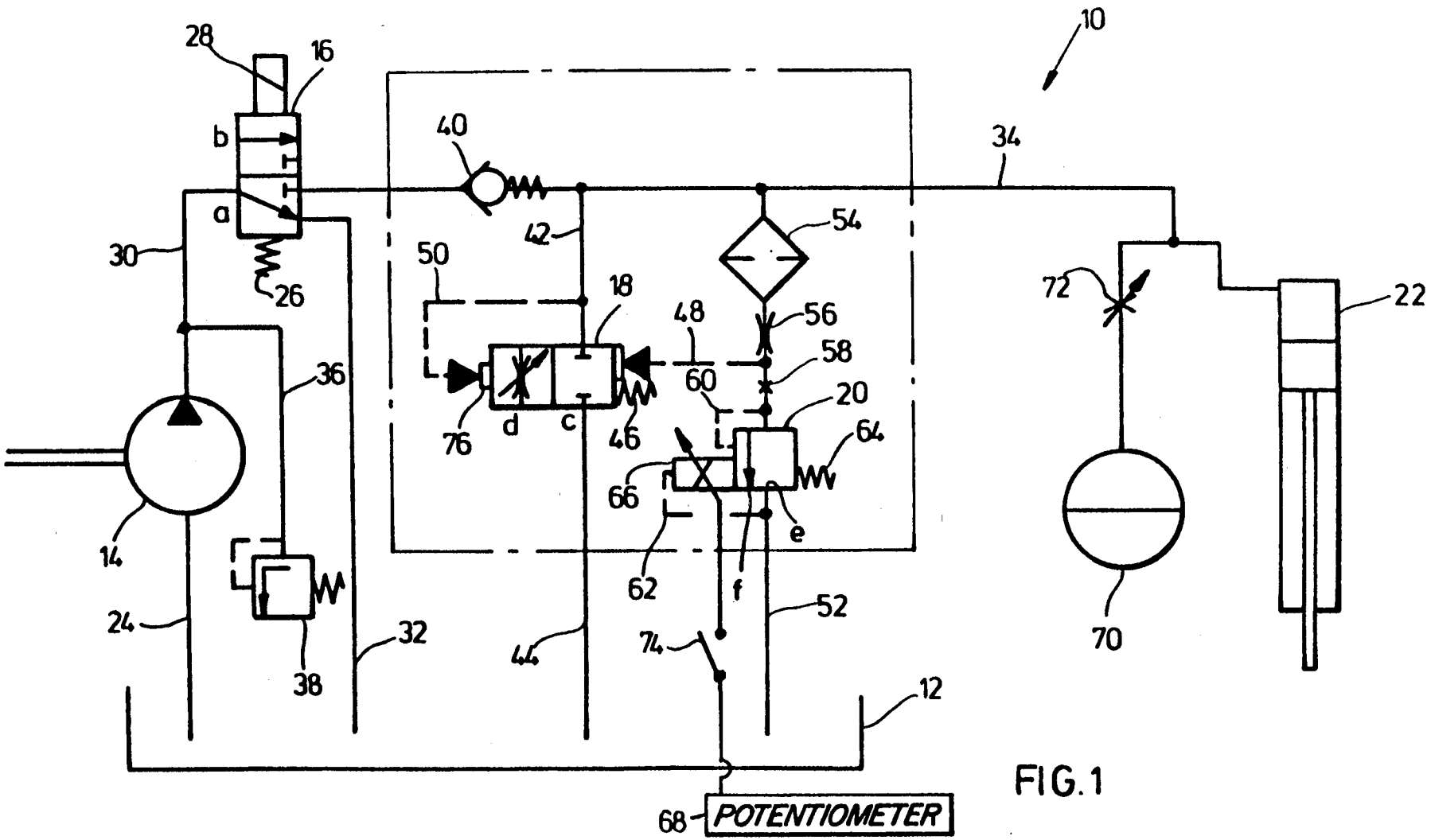
FIG. 1 is a hydraulic schematic of the present hydraulic system.

Hydraulic system 10, illustrated in FIG. 1, comprises a fluid reservoir 12, a pump 14, a valve 16, a main valve 18, a pilot valve 20 and a hydraulic device 22.

Such a hydraulic system 10 controls the lifting and/or lowering of an object that is coupled to the hydraulic device, by controlling its vertical position and the contact force. The object may be an implement that is coupled to a vehicle, or a harvesting header on a harvesting machine, a blade on a loader or dredge or a claw on a logging machine. Beyond that numerous other applications are possible.

Fluid stored in the reservoir 12, is drawn out of the reservoir and pressurized by the pump 14.

The pump 14 is designed as a continuous-acting constant flow pump, driven by a motor, not shown. A suction line 24 extends between the pump 14 and the reservoir 12. The output flow of the pump 14 maybe 18 liter/min.

The valve 16 is configured as a two-way valve with three connections, it connects the pressurized fluid from the pump 14 in a first position a with the reservoir 12, and in a second position b with the hydraulic device 22. The valve is a spring biassed solenoid valve having a spring 26 on one side, and a solenoid 28 on the other side. In a normal position the spring 26 moves the valve 16 to position a. Since the valve 16 is configured as an on-off valve, it can occupy only one of the aforementioned positions, but not any intermediate positions. A supply line 30 extends from the pump 14 to the valve 16, a return line 32 extends from the valve 16 to the reservoir, and a supply line 34 extends from the valve 16 to the hydraulic device 22.

A return line 36 branches from the supply line 30 and leads to a conventional pressure relief valve 38, which opens at a preset maximum allowable pressure and permits pressurized fluid to bleed off to the reservoir 12. The maximum allowable pressure is above the normal operating pressure of the hydraulic device 22.

In the supply line 34 a spring-loaded check valve 40 is provided that can open in the direction towards the hydraulic device 22.

The main valve 18 is configured as a two-position valve with two connections and is connected on its inlet side to a supply line 42 and to a return line 44 on its outlet side. The line 42 forms a connection between the line 34 leading to the hydraulic device 22 and the main valve 18; the line 44 leads to the reservoir 12. Of the two possible positions c and d, the first position c blocks the flow of fluid through the main valve 18, while the second position d forms a connection between the lines 42 and 44. The flow volume through main valve 18 can be varied, as will be described below. For this example it will be assumed that the maximum flow volume is 35 liter/min.

On one side, the right side as seen in FIG. 1, the main valve 18 is biassed by a spring 46. A first pilot line 48 is connected to the same side of the valve as the spring 46. A second pilot line 50 is connected to the other side of the valve 18. The pilot line 50 is connected to the supply line 42, and hence is exposed at all times to the pressure applied at the hydraulic device 22.

The pilot valve 20 is inserted in a line 52 that branches from the line 34 and leads to the reservoir 12. A filter 54, a throttle 56, an orifice 58 and the pilot valve 20 are provided in that sequence in the line 52. The first pilot line 48 branches off from line 52 between the throttle 56 and the orifice 58.

A third pilot line 60 is connected at one end to the line 52 between the orifice 58 and the pilot valve 20, and at the other end to a side of the pilot valve 20. A return oil line 62 is connected at one end to the pilot valve 20 and at the other end connected to the line 52 between the pilot valve 20 and the reservoir 12. Finally the pilot valve 20 is biassed on one side by a spring 64, which is opposed to the pressure in the pilot line 60. At all times the pilot line 60 is subject to the same pressure as that applied to the hydraulic device 22. However this pressure maybe reduced slightly due to the flow losses in the throttle 56 and the orifice 58. A solenoid 66 is located on the same side of the valve 20 as pilot line 60 and opposite to the spring 64. Preferably the solenoid 66 is configured as a proportional solenoid; in any case solenoid 66 has a known constant hysteresis.

In its rest position the pilot valve 20 is forced by the spring 64 into a blocking position e in which the connection between the line 34 and the reservoir 12 through the line 52 is blocked. In the rest position the solenoid 66 is not energized, and the pressure existing in the pilot line 60 is not sufficient to overcome the force of the spring 64. In order to compress the spring 64 it is necessary, to energize the solenoid 66. In order to move from a blocking position e to a through position f the solenoid must also be energized. The solenoid 66 is an electromagnet with an inverted characteristic, as can be seen in FIG. 2. The voltage or current flow applied to it can be varied in its magnitude by a potentiometer 68 through a switch 74. Depending on the magnitude of the applied voltage or the applied current flow, the force with which the solenoid 66 opposes the spring 64 is larger or smaller and hence also the return flow of pressurized fluid out of the line 34. On an agricultural machine the potentiometer 68 is located on an operator console, and can be adjusted from there. The control is selected so that the pilot valve 20 is fully open when the full voltage/current flow is applied to the solenoid 66.

The hydraulic device 22 is configured as a single-acting linear hydraulic motor, whose piston can lift a load. A pressure accumulator 70 is connected to the line 34 in parallel with the hydraulic device 22, where the inlet to the pressure accumulator 70 can be varied by a throttle 72. The throttle controls the stiffness of the hydraulic device 22.

REST POSITION

FIG. 1 shows the hydraulic system 10 in its rest position, in which the solenoids 28 and 66 are not energized. In this position, the valve 16 is forced by means of the spring 26 into position a, the main valve 18 is forced by the spring 46 into position c and the pilot valve 20 is forced by the spring 64 into position e. The pressurized fluid moved by the pump 14 then flows through the valve 16 directly into the reservoir 12 without moving the hydraulic device 22.

LIFTING OPERATION

To extend the hydraulic device 22 in the lifting direction requires only the operation of the solenoid 28. Energizing solenoid 28 shifts valve 16 to its second position b thereby allowing pressurized fluid to flow into the line 34 past the check valve 40 and to the hydraulic device 22. As soon as the pressure accumulator 70 has reached its operating pressure the hydraulic device 22 is extended. The main valve 18 and the pilot valve 20 remain in their blocking positions c and e, respectively. The lifting process ends as soon as no further voltage is applied to the solenoid 28.

LOWERING PROCESS

In order to lower the load engaging the hydraulic device 22, by retracting the hydraulic piston, the solenoid 28 is again energized and the valve 16 moved to its second position b. In addition, the solenoid 66 is energized so that its force together with the force generated by the pressure in the pilot line 60 overcomes the opposing force of the spring 64 and moves the pilot valve 20 to its second position f. The pressure applied at the right side of the main valve 18 now bleeds off through the open pilot valve 20 to the reservoir 12. Then the pressure applied at the hydraulic device 22 which is transmitted through the line 34 and the pilot line 50, which is applied to the left side of the main valve 18, causes the main valve 18 to move to its second position d in which pressurized fluid from the hydraulic device 22 flows to the reservoir 12. However the amount of this flow is limited to the difference between the maximum flow capacity through the main valve and the flow produced by the pump 14. For example, if the flow through the main valve is not throttled and the main valve has a capacity of 35 liter/min and the pump has a capacity of 18 liter/minute, 17 liter/minute of fluid can be drained form the hydraulic device 22 to the reservoir 12.

Position Control with Preset Contact Pressure

The hydraulic system can be adjusted so that the hydraulic device 22 moves into contact position with a pre-determined contact force. For example, the hydraulic device 22 may be used to lower the cutting head of a combine to the point that it makes contact with the ground with a certain force.

To initiate the position control it is necessary to establish a relationship between the contact pressure of the hydraulic device 22 or the implement attached to it, that is built up in the line 34, and the voltage applied to the solenoid 66. First the hydraulic device 22 is retracted fully in order to reduce the pressure in the line 34 as much as possible. Next the solenoids 28 and 66 are energized through a switch, not shown, so that the valve 16 moves to its second position f and pressurized fluid flows to the hydraulic device 22. In addition the switch 74 is closed so that voltage is applied to the solenoid 66, which should be the maximum voltage/current flow at the beginning of the adjusting process. Although a lower pressure is applied at the hydraulic device 22, which is also transmitted through the pilot line 60, its force together with the force supplied by the solenoid 66 will move the pilot valve 20 to its second position f. The main valve 18 will then move to its second position d. Now the potentiometer 68 is continually adjusted so as to reduce the voltage at the solenoid 66 until the force of the solenoid 66 together with the pilot pressure in the pilot line 60 is reduced below that of the spring 64. As soon as this occurs, the pilot valve 20 moves to its first position e, and thereupon the main valve 18 is moved to its first position c and the hydraulic device 22 is extended. The position of the potentiometer 68 at which the hydraulic device 22 moves is retained, and for the adjustment of a certain contact pressure, the potentiometer 68 is set back by an amount to be determined.

In order to make this position control effective, the hydraulic device 22 must be extended by a certain amount, that is, the lifting of the load must be initiated. In order to actuate the position control proportional to the contact pressure, the potentiometer 68 is connected to the solenoid 66 by closing the switch 74 so as to supply it with a certain voltage, which generates the pre-set force applied to the spring 64. Thus the pilot valve 20 is preloaded. In addition the solenoid 28 is energized so that the valve 16 permits the flow of pressurized fluid into the line 34. The application of voltage to the solenoid 28 and 66 occurs for a certain time, for example, 5–6 seconds; this time interval can also be controlled by a timer such as a relay or the like. If the pressure at the hydraulic device 22 is too high, the hydraulic device 22 will be lowered according to the above description of the adjustment process.

When the contact pressure control is actuated, the adjusting pressure at the pilot valve 20 is always controlled by the initial voltage or the initial current I or U=0. This means that any errors are a problem of repeatability, not of hysteresis. With this hydraulic system 10 it is possible by operating one switch to supply current to the solenoids 28 and 66 to control the pressure in the system at a constant value and therewith to control the contact pressure.

If any incident at the hydraulic device 22 causes a pressure rise in the line 34 that is sufficiently large, together with the force of the solenoid 66 to overcome the force of the spring 64, then the pilot valve 20 opens the connection to the reservoir 12, the pressure in the pilot line 48 bleeds off and the pressure in the pilot line 50 moves the main valve 18 to its second position d in which pressurized fluid can return from the hydraulic device 22 to the reservoir 12. The pressurized fluid can continue flowing until the pressure rise in the lines 34, 52 has decayed, and the spring 64 is able to close the pilot valve 20, with the result that the pilot pressure on the right side of the main valve 18 increases and this valve also closes. As a result the hydraulic device 22 will lower the load until it makes contact, for example, with the ground with the pre-determined force. It is clearly evident that a change in the voltage at the solenoid 66 can vary the time or pressure point at which the pilot valve 20 opens and initiates the control process.

If the position control last described is not in operation, the switch 74 is opened so that no voltage is applied through the potentiometer 68 to the solenoid 66.

As initially noted, the maximum flow through the main valve 18 can be varied manually by an adjusting screw 76, as is shown in FIG. 3. In that way the maximum flow of 35 liter/min. could be reduced, for example, to 30 liter/min. As a result, during a lowering process in which the flow of pressurized fluid from the pump 14 is 18 liter/min., only 12 liter/min. can flow from the hydraulic device 22; accordingly the lowering speed is reduced. Instead of a manually operated adjusting screw 76, an electrically controlled adjusting arrangement may also be used.

It should be noted that the designations left and right and the like refer only to the directions as seen in FIG. 1 of the drawing. Obviously, in a practical configuration, for example, that shown in FIG. 3, springs, magnets, lines, pilot line may be connected at other locations, as long as the operation of the hydraulic system 10 remains the same.

FIG. 3 shows a valve block 78 which contains the solenoids 28 and 66, the valve 16, the main valve 18, the pilot valve 20 and the adjusting screw 76. A detailed explanation is unnecessary since the connections and the operating process are the same as above, with the exception that the valve 16 is not 35 actuated directly by means of the solenoid 28, but is pilot controlled. However, this is already known from TM1352, page 270-20-5 and 270-20-7 through 270-20-9, Mar-86, from John Deere, so that here too, no further explanation is needed.

The adjusting screw 76 is threaded into a housing 82 by means of a sleeve 80 so that it can be moved longitudinally in the valve body. The adjusting screw acts upon a spring 46 which forces a slide 84 of the main valve 18 against a seat 86. The more the adjusting screw 76 is moved toward the spring 46, the more it is compressed and the less the slide 84 can deflect at constant pressure, and thereby change the flow area.

The solenoid 66 has a defined characteristic (hysteresis), which can be described by a simple or a complicated mathematical formula. Hence it is possible to calculate precisely the force generated by the solenoid 66 in each of its positions and under each voltage or current flow value. Since this force simultaneously represents the control pressure such a change can vary the timing or the extent of the opening or closing of the pilot valve 20.

At full voltage/current flow the pilot valve 20 operates as on/off valve and does not have any intermediate positions. Therefore it is eminently suitable for manual operation, if desired.

The hydraulic system according to the invention is particularly applicable for contact force control of the hydraulic device, but also for the control of its position. As such, it should not be limited to the above-described embodiments, but should be limited solely by the claims that follow.

I claim:

1. A hydraulic system for the controlling of the contact force of a hydraulic device, the system comprising:

a source of fluid pressure;

a hydraulic device in fluid communication with the source of pressurized fluid, the hydraulic device can be extended and retracted;

a pilot-controlled main valve in fluid communication with the source of fluid pressure and the hydraulic device, the pilot controlled main valve has a first position which prevents the flow of fluid through the valve and a second position which permits the flow of fluid through the valve, the pilot controlled main valve controls how fast the hydraulic device is retracted;

a second pilot-controlled valve is in fluid communication with the source of fluid pressure, the hydraulic device and the pilotcontrolled valve, the second pilot-controlled valve is provided with a proportional solenoid for biassing the valve, the second pilot-controlled valve controls the positioning of the pilot-controlled main valve, the position of the second pilot-controlled valve is biassed by the fluid pressure applied to the hydraulic device in the same direction as the force of the proportional solenoid, the means for controlling how the proportional solenoid is energized.

2. A hydraulic system as defined by claim 1 wherein the second pilot-controlled valve is provided with a spring which biases the valve against the fluid pressure applied to the hydraulic device.

3. A hydraulic system as defined by claim 2 wherein the main pilot controlled valve has an adjustable passage through which the flow of fluid can be varied.

4. A hydraulic system as defined by claim 3 wherein the second pilot controlled valve performs as an on-off valve.

* * * * *

UNITED STATES PATENT AND TRADEMARK OFFICE

CERTIFICATE OF CORRECTION

PATENT NO. : 5,355,773

DATED : October 18, 1994

INVENTOR(S) : Gunter Winkels

It is certified that error appears in the above-indentified patent and that said Letters Patent is hereby corrected as shown below:

Column 8, line 1, delete "pilotcontrolled" and insert --pilot-controlled--.

Column 8, line 9, delete "the" (first occurance) and insert --and--.

Signed and Sealed this

Tenth Day of January, 1995

*Attest:*

*Attesting Officer*

Bruce Lehman

BRUCE LEHMAN

*Commissioner of Patents and Trademarks*